US005285602A

United States Patent [19]

Felton

[11] Patent Number: 5,285,602

[45] Date of Patent: Feb. 15, 1994

[54] MODULAR WALL SYSTEM WITH "SLIDEBY" MOUNTING FEATURE

[75] Inventor: J. Reed Felton, Milwaukee, Wis.

[73] Assignee: T. J. Hale Company, Menomonee Falls, Wis.

[21] Appl. No.: 848,657

[22] Filed: Mar. 9, 1992

[51] Int. Cl.[5] ..... A47B 5/02; F04B 2/78

[52] U.S. Cl. ..... 52/36.6; 52/36.5; 52/286; 52/282.1; 52/127.2; 52/127.6; 52/238.1

[58] Field of Search ..... 52/36.6, 127.2, 127.6, 52/277, 238.1, 286, 36.5, 282.1

[56] References Cited

U.S. PATENT DOCUMENTS

| | | | |
|---|---|---|---|
| 2,040,385 | 5/1936 | Kellogg | 72/0.5 |
| 2,940,605 | 6/1960 | Logie et al. | 211/148 |
| 3,193,885 | 7/1965 | Gartner et al. | 20/4 |
| 3,197,929 | 8/1965 | Halbostad | 52/241 |
| 3,305,981 | 2/1967 | Biggs et al. | 52/36 |
| 3,394,507 | 7/1968 | Doke | 52/36 |
| 3,714,748 | 2/1973 | Costruba | 52/36.6 |
| 3,730,477 | 5/1973 | Wavrunek | 248/243 |
| 3,778,939 | 12/1973 | Nelsson | 52/36 |
| 3,810,340 | 5/1974 | Nelsson | 52/729 |
| 3,848,364 | 11/1974 | Costruba | 52/36 |
| 3,859,765 | 1/1975 | Nelsson | 52/241 |
| 3,920,846 | 12/1975 | Mader et al. | 52/479 |
| 3,925,939 | 12/1975 | Costruba | 52/36 |
| 4,048,768 | 9/1977 | Good | 52/286 |
| 4,086,978 | 5/1978 | Clements | 52/36.6 |
| 4,242,970 | 1/1981 | Suttles et al. | 108/159 |
| 4,441,300 | 4/1984 | Varon et al. | 52/732 |
| 4,535,525 | 8/1985 | Varon et al. | 29/463 |
| 4,570,390 | 2/1986 | Wendt | 52/36 |
| 4,581,859 | 4/1986 | Doke et al. | 52/36 |
| 4,587,774 | 5/1986 | Wendt | 52/36 |
| 4,588,156 | 5/1986 | Doke et al. | 248/243 |
| 4,688,750 | 8/1987 | Teague | 248/243 |
| 4,839,999 | 6/1989 | Clemens et al. | 52/36 |
| 4,893,446 | 1/1990 | Gudmundsson et al. | 52/238.1 |
| 4,918,879 | 4/1990 | Bodurow et al. | 52/36.6 |
| 4,960,210 | 10/1990 | Spamer | 211/59.2 |
| 5,004,201 | 4/1991 | Bessinger | 248/243 |
| 5,015,421 | 5/1991 | Messner | 261/122 |

OTHER PUBLICATIONS

Amstore Product Literature (2 pages).
HBSA "Visu-Wall" Product Literature (1 page).
OPTO International Ltd., Product Literature (1 Page).
Columbus Showcase Company "Wallsell" System Literature (4 pages).
Krueger International "Systems Wall" Literature (16 pages).
Clemco Roll Forming Product Literature (2 pages).
Garcy Corporation Product literature (6 pages).

*Primary Examiner*—Carl D. Friedman
*Assistant Examiner*—Christopher T. Kent
*Attorney, Agent, or Firm*—Jansson & Shupe, Ltd.

[57] ABSTRACT

The invention is an improvement in a modular wall system of the type having a forward standard for attaching a merchandising display thereto. Such system also has a rearward pair of laterally-extending flanges, a web extending between each flange and the standard and at least one opening in each web for wall panel attachment. The improvement includes at least one (and preferably at least two) "slideby" brackets mounting a panel to a web. Each bracket has at least one tongue extending through the opening for slide-and-release panel mounting. The panel and attached bracket are thereby mounted or demounted without tools.

11 Claims, 4 Drawing Sheets

FIG. 7
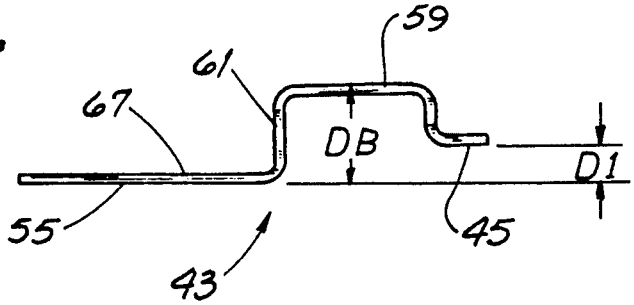
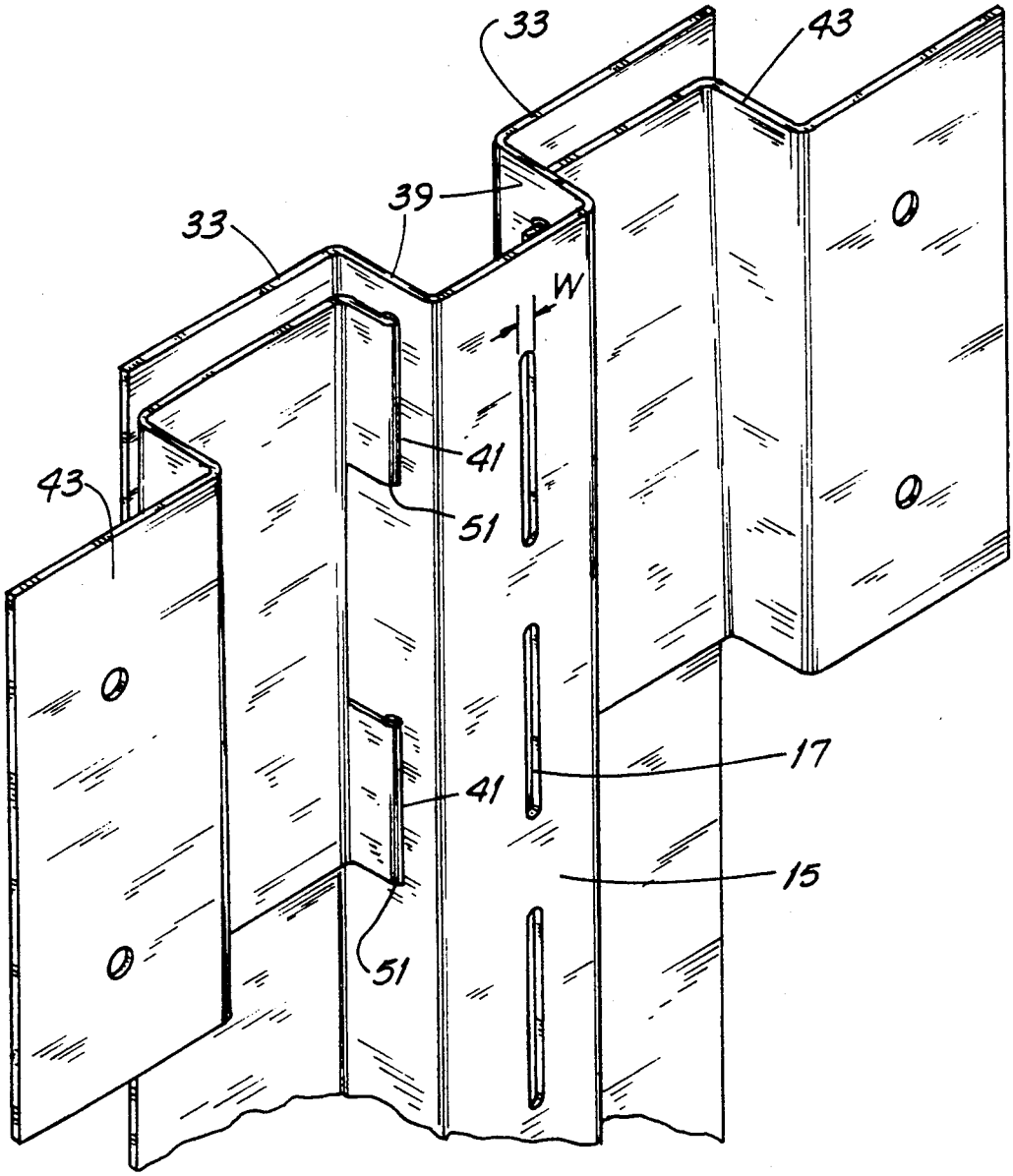
FIG. 5

MODULAR WALL SYSTEM WITH "SLIDEBY" MOUNTING FEATURE

FIELD OF THE INVENTION

This invention is related generally to interior building walls and, more particularly, to such walls constructed to display products thereon.

BACKGROUND OF THE INVENTION

Department and other types of retail stores frequently display products on perimeter or interior walls specially configured for the purpose. Such products may be hung from hooks or brackets or displayed upon shelves which, themselves, are supported by brackets projecting from the wall. Often, such specially-configured walls are provided and installed by contractors or by contracting manufacturers on a bid basis.

Special walls constructed for the particular purpose of product display are said (in the vernacular of the industry) to include "wall standards," "key stripping" or "in-line standards." As used in the industry (and as used herein) the term "standard" is a noun referring to a vertically-oriented component, usually metal, which has spaced elongate slots along its length. Ends of support hooks or brackets are inserted into such slots to hold products or shelves.

Sometimes the wall is constructed so that the standard is concealed except to close inspection; in other wall arrangements, the standard is surface mounted. The former type is most often used commercially; the latter type is often used in private residences to make book shelves and the like. With surface mounted standards, the slotted standard is merely an "add-on" to an existing conventional wall. Of course, a benefit of wall standards is that hooks and brackets can be placed at any of a number of locations along the standard—and can just as easily be re-located as displays of products are modified to meet changing marketing needs.

Design, manufacture and installation of existing wall standard mounting systems, especially those used commercially in department stores and the like, are attended by frequently-occurring obstacles in the manufacture and sale of "wall standard" type wall display systems. These systems are very frequently sold as part of a bid project.

One obstacle is that some known systems require an existing wall for system mounting. One such system, offered by Garcy Corporation, requires that furring strips be applied to a wall before the display wall system is installed. To the extent any such system requires a wall, it loses an enormous amount of flexibility in wall placement. To put it another way, such wall display systems must be installed according to the dictates of the existing building rather than in locations most effective from a display standpoint.

U.S. Pat. No. 4,918,879 (Bodurow et al.) shows a wall mounting system using a rotary bolt lock to mount a panel. The bolt lock is mortised into a cavity cut into the panel edge. Locking and unlocking (for mounting and de-mounting, respectively) is by an Allen wrench inserted into an opening exposed at the panel front.

U.S. Pat. No. 3,848,364 (Costruba) shows a shelving support structure using sheet metal studs in a spaced, back-to-back arrangement. The studs are spaced apart by interlock members placed between the studs and each interlock member has a pair of oppositely-extending flange portions overlapping a stud flange. The structure uses spot welding and "groups" of screws to construct the standard and mount panels thereon. Such patent also illustrates how a free standing wall is constructed.

U.S. Pat. No. 3,193,885 (Gartner et al.) shows what is said to be a quickly-erectable wall with a floating wood stud. Studs are made up in advance to have several vertically-spaced clips inset into the stud by a dimension such that the laterally extending tongues of the clips are spaced away from the stud somewhat. Companion panels are grooved to accept the tongues as the studs are slipped into place.

U.S. Pat. No. 3,730,477 (Wavrunek) shows an arrangement for supporting a wall standard and permitting wall panel mounting so that the panel adjacent ends are relatively close together. U.S. Pat. No. 4,570,390 (Wendt) shows an approach somewhat like that of the Wavrunek patent and also illustrates panel notching and shaping as an aspect of panel mounting.

U.S Pat. No. 4,588,156 (Doke et al.) shows a bracket support structure in which each support has oppositely extending flanges parallel to the finished wall. Each such flange attaches to the flange of a sheet metal stud. Each support also has a pair of outward extending blades against which vertical edges of the wall board sections abut in the finished wall. The blades are of fixed dimension made to "match" wall board of a particular thickness.

U.S. Pat. No. 2,040,385 (Kellogg) shows a wall assembly using pin-and-slot mounting. Slots are cut into flanges of special studs, thereby negating the possibility of using standard sheet metal studs. U.S. Pat. No. 4,893,446 (Gudmundsson et al.) shows a relocatable vertical or horizontal wall system. The patent illustrates various ways to mount panels. Insofar as can be determined, all system components are "special." That is, standard sheet metal studs are not used and cannot be used.

Literature by Garcy Corporation describes three systems, namely, Image Plus, Adapt-A-Stud and Garcy/Stud. The first contemplates installation on furring strips mounted on an existing wall. Exterior exposed panels are retained by a rear mounted angle bracket and spring catch. The Adapt-A-Stud system uses slotted adapters mounted to a pair of spaced sheet metal studs. The slotted standard is secured with two screws through a housing and into anchor clips. The Garcy/-Stud system combines the structure of two back-to-back sheet metal studs with a slotted standard. The standard is secured as in the Adapt-A-Stud system. Gypsum wall board can be mounted on both sides. It is unclear on how the wall board is secured, but it is believed to be held by fitting it into top and bottom channels as with the Image Plus system.

Another obstacle is that, characteristically, known wall standard systems are very labor intensive and require a good deal of on-site "cut and fit" by skilled, well-compensated persons. To state it differently, such systems do not lend themselves well to partial, more rapid wall fabrication at a remote manufacturing site where proper tools, jigs and the like are available.

Still another disadvantage of some known wall standard systems is that they fail to take full advantage of "parts commonality." That is, each system component is configured for a particular use in a particular part of the system and cannot be used "double duty" in any other way.

The inventive system, summarized and described in detail below, resolves many of these disadvantages in a unique way.

OBJECTS OF THE INVENTION

It is an object of this invention to provide an improved modular wall system overcoming some of the problems and shortcomings of the prior art.

Another object of this invention is to provide an improved modular wall system whereby wall panels may be mounted or de-mounted quickly and without tools.

Yet another object of this invention is to provide an improved modular wall system which can accommodate wall panels of varying thickness without modification.

Another object of this invention is to provide an improved modular wall system useful to erect perimeter or free-standing interior display walls.

Still another object of this invention is to provide an improved modular wall system in which the standard and its slots are substantially concealed from view.

Another object of this invention is to provide an improved modular wall system lending itself to substantial prefabrication at a remote manufacturing site.

Another object of this invention is to provide an improved wall standard mounting system using conventional wall studs, preferably sheet metal studs, in system construction. These and other important objects will be apparent from the following detailed description taken in conjunction with the drawing.

SUMMARY OF THE INVENTION

The inventive system facilitates construction of a modular wall system with a degree of ease and economy not before possible. The invention is an improvement in a modular wall system of the type having a forward standard for attaching a merchandising display to it. The system has a rearward pair of laterally-extending flanges and a web extending between each flange and the standard. In cross-section, the standard, flanges and webs form a hat-shaped structure and in practice, such structure is often formed as a single piece. Each web has at least one opening for wall panel attachment.

The improvement comprises a "slideby" bracket mounting a panel to a web and including a tongue extending through the web opening for "slide-and-release" panel mounting. That is, after the bracket is mounted to the panel (preferably at a shop site where jigs and fixtures are available), the panel is slid laterally so that the bracket tongue is inserted into and extends through the web. When so positioned, the panel is simply released and is supported in place. One of the many advantages of the improved system is that the bracket-attached panel may be mounted or demounted without tools.

More specifically, the tongue includes a downwardly-extending, hook-like projection engaging and slightly overlapping the lower end of the web opening. The interference between the projection and the lower end requires that the panel be lifted for removal. And the projection limits undesirable, lateral panel movement after the panels are in place. In other words, the mounted panels are relatively restrained against movement and do not significantly "wander" from location. Otherwise, lack of "location stability" might impair other features of the improved system.

And that is not all. Since the improved system is used to create highly attractive merchandise displays, such system is configured with aesthetic considerations in mind. For example, the webs and the bracket each have a front-to-rear dimension, such dimensions are substantially equal to one another and the mounted panel abuts the standard. In particular, the bracket has a front surface spaced forwardly of the tongue by a first dimension and the standard has a front face spaced from the web opening by a second dimension which is substantially equal to the first dimension. So configured, the panel rear surface abuts the standard face when the panel is mounted. For reasons that will become apparent, such standard-panel abutment is preferred in view of other structural factors.

One such factor relates to the structural features of the standard itself. It includes a relatively-wide front face having a number of vertically-spaced, vertically-formed slots. The slots must be available across their full width in order to receive, for example, a shelf support bracket. However, the face of the standard and its slots are generally considered to be aesthetically unattractive.

In the improved system, the brackets are readily located on and attached to the rear panel surface so that the space between exposed vertical edges of adjacent panels is substantially equal to the slot width. The standard and slots are thereby substantially concealed from view. And this desirable result is accomplished while yet avoiding time-consuming "notching" or otherwise shaping such panel edges.

Panel-bracket attachment is also in a way which preserves aesthetics. The panel has a rear surface and the bracket (and panel mounted thereby) are attached to one another by at least one fastener inserted through the bracket to engage the rear surface. The fastener has a length less than the panel thickness so that the exposed front surface of the panel is not pierced by a protruding fastener and surface appearance is preserved.

Another desirable feature of the improved system is that walls can be constructed so that readily-slideby-mounted panels are the only panels needed. That is, the builder need not employ "backing" structures, e.g., additional panels or the like in order to build the wall.

In a highly preferred arrangement, the improved system is integrated into a modular wall frame defining a wall opening. The frame has a plurality of vertical studs and the flanges are attached to and abut the studs. The opening is covered solely by one or more panels mounted by slideby brackets.

And such modular walls can be constructed against and on top of an existing wall or they may be spaced well away from the existing wall and extend between ceiling and floor. Merchandise display systems are often constructed using free standing "half-walls" to define a partially enclosed area. Products are displayed on the outer side of the wall and a sales person, sale register and the like located in the partially enclosed area.

Further details of the improved system are set forth in the following detailed description taken in conjunction with the drawing. After understanding the disclosure, persons of ordinary skill will appreciate how such system is used to make various types of walls and accompanying displays.

BRIEF DESCRIPTION OF THE DRAWING

FIG. 5 is a perspective view of the standard and mounting brackets shown in FIG. 4.

FIG. 7 is a top plan view of the bracket of FIG. 6 taken along the viewing axis VA7 thereof.

DETAILED DESCRIPTION OF PREFERRED EMBODIMENTS

Figure 1:
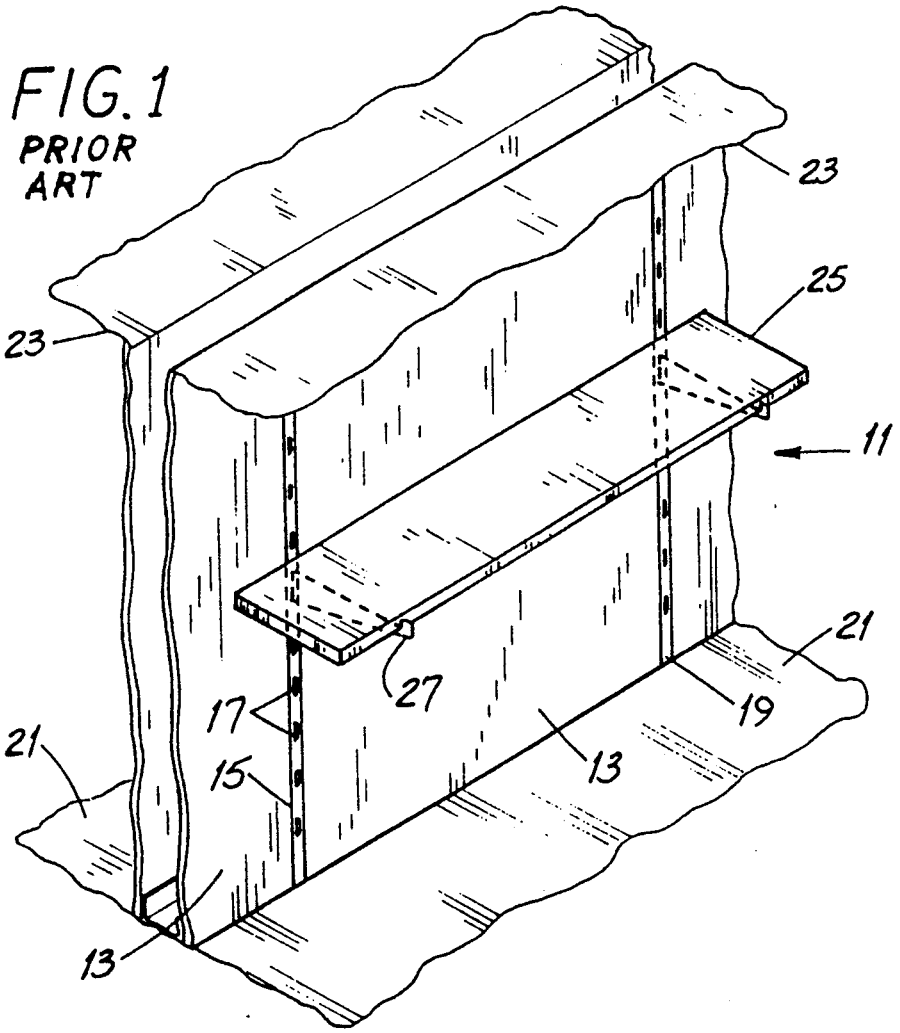
FIG. 1 PRIOR ART
FIG. 1 is a representative perspective view, with parts broken away and other parts in phantom outline, of a "wall standard" type display wall.

Before describing the details of the inventive system 10, readers will find it helpful to refer to FIG. 1 showing how such system 10 is used. The illustrated wall 11 includes outer panels 13, often decorative, seen by individuals viewing displayed products. The wall 11 includes one or more vertical "standards" 15 with slots 17. In practice, the standard 15 is "inset" somewhat behind the panels 13 and is visible only upon closer inspection. However, the gap 19 between panels 13 is clearly visible and is considered by many to detract from the aesthetics of the display. As described below, the inventive system 10 offers (among other advantages) a way to minimize the width of such gap 19.

Figure 4:
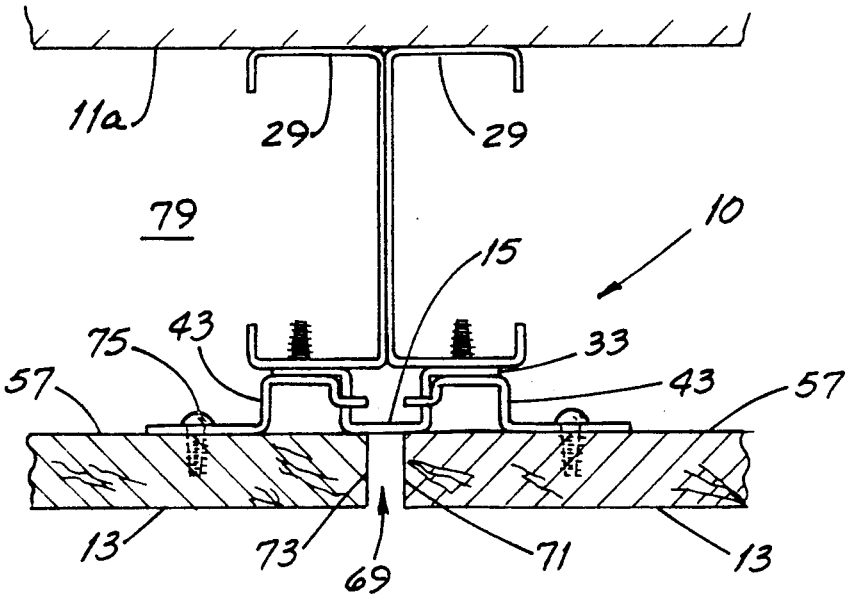
FIG. 4 is a cross-sectional plan view, with parts broken away, similar to that of FIG. 3 and including mounted panels and panel brackets.

The display wall 11 may extend between floor 21 and ceiling 23 as shown or be foreshortened, e.g., to countertop height. The wall 11 may be single-sided and mounted to an existing perimeter wall 11*a* as shown in FIG. 4. Or it may be double sided as shown in FIG. 1. Products are displayed on one or more shelves 25 supported by brackets 27 hooked into slots 17. Typically, there are a number of slots 17 along the standard 15 so that the vertical position of the shelf 25 can be selected for most advantageous product display. And only a single bracket 27 or hook can be used to display, for example, purses hung therefrom.

Figure 2:
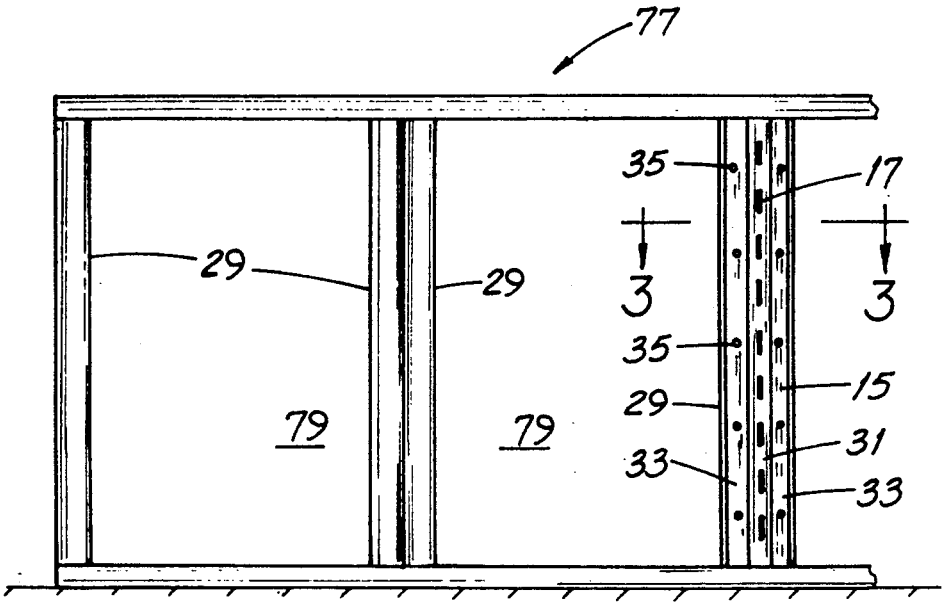
FIG. 2 is an elevation view of a modular wall "skeleton" or frame constructed of studs and including a standard mounted thereon.
Figure 3:
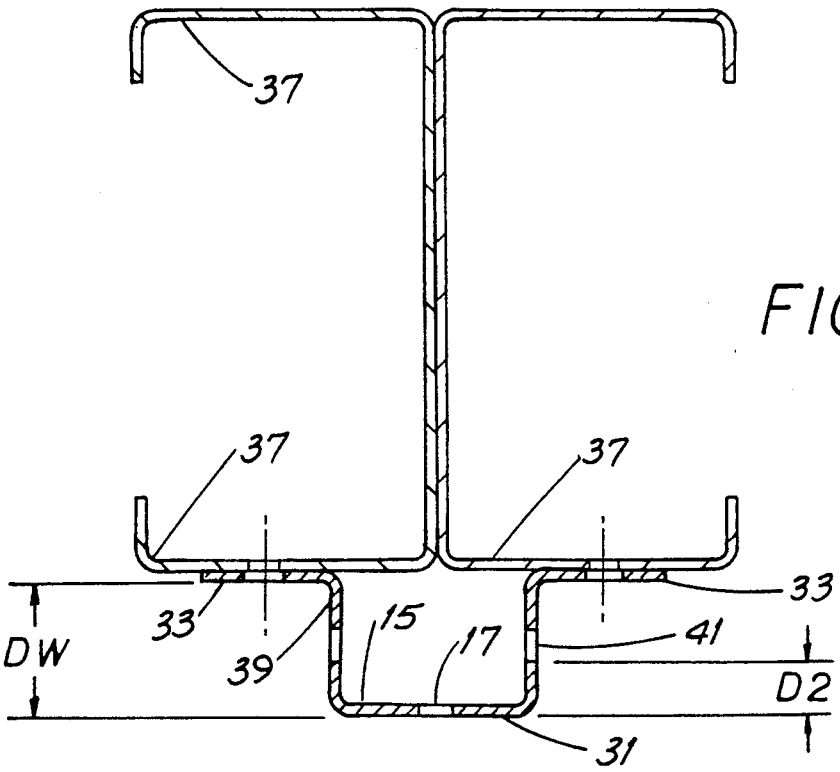
FIG. 3 is a cross-sectional plan view taken along the viewing plane 3—3 of FIG. 2.

Referring next to FIGS. 2 and 3, the inventive system 10 preferably uses commonly-available (and, at least for commercial work, widely-used) sheet metal studs 29. Such studs 29 are dimensionally stable, light in weight and readily drilled for sheet metal screws. The system 10 has a forward-positioned standard 15 for attaching a merchandising display to it. The standard 15 has a front face 31 and a plurality of relatively narrow, vertically-oriented slots 17 through the face 31. Such slots 17 preferably have a width selected to receive a bracket 27 with slight clearance. And to accommodate bracket mounting tabs, the slots 17 are spaced apart by the same distance as the tabs.

The system 10 also has a rearward-positioned pair of laterally-extending flanges 33 which are generally parallel to the face 31 and in "on-line" alignment with one another. Each flange 33 includes a plurality of fastener holes 35 for attaching a flange 33 to an edge plate 37 of a stud 29 as described in more detail below.

A web 39 extends between each flange 33 and the standard 15 and are arranged generally parallel to one another and normal to the flanges 33 and the standard face 31. As shown in cross-section in FIGS. 3 and 4, the standard 15, flanges 33 and webs 39 form what may be described as an inverted "hat-shaped" structure. In practice, such structure is often formed as a single piece.

Referring additionally to FIG. 5, each web 39 has at least one slit-like opening 41 (and, preferably, a number of such openings 41 vertically-spaced from one another) for wall panel attachment by one or more panel support brackets 43. The "width" of each opening 41 (as measured between flange 33 and the standard 15) and the thickness of each bracket tongue 45 are cooperatively selected so that the opening 41 can receive the tongue 45 therethrough with very slight clearance.

Figure 6:
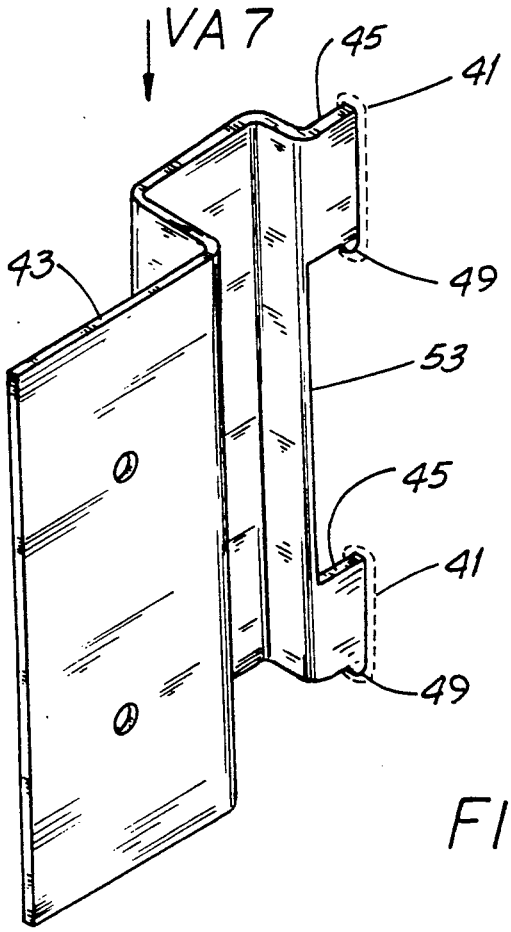
FIG. 6 is a perspective view of a panel mounting bracket with "mating" web openings shown in dashed outline.

Referring additionally to FIGS. 6 and 7, one or more "slideby" brackets 43 support of a panel 13 on a web 39. Each bracket 43 has one or more tongues 45, each of which extends through a web opening 41 when the panel 13 is mounted. If plural tongues 45 are used on each bracket 43 (two are preferred), the vertical spacings of pairs of tongues 45 and openings 41 are nominally equal to one another.

Noting FIGS. 4 and 5, it will be appreciated that the panel 13 and bracket 43 provide "slide-and-release" panel mounting. That is, when the panel 13 is grasped and the bracket 43 slid laterally along the flange 33 until the tongues 45 are through the openings 41, the panel 13 is then simply released and is supported in place. One of the many advantages of the improved system 10 is that the bracket-attached panel 13 may be mounted or demounted without tools. The reason why such feature is desirable is explained below.

Referring particularly to FIG. 6, at least one tongue 45 of each bracket 43 includes a downwardly-extending projection 49 which in the preferred embodiment is hook-like. As a panel 13 is mounted, the projection 49 extends somewhat below the lower end 51 of the web opening 41. If the panel 13 is moved laterally outward away from the standard 15, the resulting "interference" between the projection 49 and the opening lower end 51 limits travel and prevents removal. Such configuration requires that for removal, the panel 13 be lifted slightly until the projection 49 "clears" the lower end 51. It is now apparent that height of the web opening 41 is selected to be slightly greater than the overall vertical height of the tongue 4 and projection 49.

And in a highly preferred embodiment, the tongue 45 is arranged so that its projection 49 limits undesirable, lateral panel movement after the panels 13 are in place. The location of the projection 49 with respect to the outer bracket wall 53 is selected so that the wall 53 and projection 49 are spaced by about the thickness of the web 39. In that way, the mounted panels 13 are relatively restrained against lateral movement and do not significantly "wander" from location. Otherwise, lack of "location stability" might impair other features of the improved system described below.

To illustrate how the improved system 10 is configured with aesthetics in mind, the webs 39 and the bracket 43 each have a front-to-rear dimension identified as DW and DB, respectively, in the drawing. Such dimensions are substantially equal to one another so that when a panel 13 is mounted, such panel 13 abuts the standard 15.

Considered another way, the bracket 43 has a generally planar front surface 55 spaced forwardly of the tongue 45 by a first dimension D1. The standard 15 has a generally planar front face 31 spaced from the web opening by a second dimension D2 which is substantially equal to the first dimension D1. So configured, the panel rear surface 57 abuts the standard face 31 when the panel 13 is mounted. A preferred bracket 43 has its tongue 45, outer wall 53, rear wall 59, inner wall 61 and panel attachment plate 67 formed as a one-piece, unitary structure with each aforementioned component (e.g., tongue 45, wall 53) being at right angles to the adjacent component. For reasons that will become apparent, standard-panel abutment (rather than, e.g., panel "notching") is preferred in view of other structural factors.

One such factor involves the variety of panel thicknesses accommodated by the improved system 10. Specifically, such system 10 is "thickness insensitive"—panels 13 having differing thicknesses can be mounted without modification, even in the same wall 11, if needed.

Another factor relates to the structural features of the standard 15 itself. It includes a relatively-wide front face 31 having a number of vertically-spaced, vertically-formed slots 17 in it. The slots 17 must be available across their full width in order to receive, for example, the tabs of a shelf support bracket 27 as described above. However, the face 31 of the standard 15 and its slots 17 are generally considered to detract from the appearance of the wall 11.

As shown in FIG. 4, the brackets 43 of the improved system 10 are located on and attached to the rear panel surface 57 so that the space 69 between exposed vertical edges 71, 73 of adjacent panels 13 is substantially equal to or only slightly greater than the slot width W. The standard 15 and slots 17 are thereby substantially concealed from view except, possibly, from that of an observer standing directly in front thereof. And this desirable result is accomplished while yet avoiding time-consuming "notching" or otherwise shaping such panel edges 71, 73 as with certain prior art arrangements.

Panel-bracket attachment is also in a way which preserve aesthetics. The bracket 43 is attached to the rear surface 57 of the panel 13 by at least one fastener 75 inserted through the bracket 43 to engage and penetrate such surface 57. However, the fastener 75 has a length selected to be less than the thickness of the panel 13 so that the exposed front surface of the panel 13 is not pierced by a protruding fastener 75. Surface appearance is preserved. Of course, one may elect to use an ornamental fastener, aspects of which are clearly visible at the front of the panel 13.

Another desirable feature of the improved system 10 is that walls 11 can be constructed so that the only panels 13 needed are those which are slideby-mounted as in the improved system 10. That is, the builder need not employ "backing" structures, e.g., additional panels or the like in order to build the wall.

Referring further to FIGS. 1, 2 and 4, in a highly preferred arrangement, the improved system 10 is integrated into a modular wall frame 77 defining a wall opening 79. The frame 77 has a plurality of vertical studs 29 and the flanges 33 are attached to and abut the studs 29. The opening 79 is covered solely by one or more panels 13 mounted by slideby brackets 43.

And merchandise display systems are often constructed using free standing "half-walls" to define a partially enclosed area. Products are displayed on the outer side of the wall and a sales person, sale register and the like located in the partially enclosed area. Consider, for example, the wall 11 of FIG. 1 shortened to a height of, say, 30 inches and arranged to form such a partially enclosed area.

A benefit of the improved system 10 is its ability to have very substantial, favorable impact upon the installed cost of modular wall systems. Persons in the industry acknowledge that wall fabrication at the site of installation, sometimes involving highly paid but less-than-fully-utilized tradesmen, is expensive. The new system 10, especially including panels 13 and attached brackets 43, can be assembled at a shop site where jigs, fixtures, a full complement of tools and the like are available. And components of entire walls 11 can be measured, cut and drilled at such a site for quick wall installation and minimum disruption of the display and sales area. Equally important is the fact that panels 13 can be removed without tools, probably by the system user. It is not unreasonable to envision a wall 11 having different sets of panels 13 constructed or decorated to promote different display themes or concepts. With the improved system 10, construction tradesmen need not be employed to interchange such panel sets.

While the principles of this invention have been described in connection with specific embodiments, it should be understood clearly that these descriptions are made only by way of example and are not intended to limit the scope of the invention. For instance, after appreciating the foregoing, one of ordinary skill will understand how to equivalently substitute a notch in the tongue 45 in place of the projection 49. And other modifications are possible without departing from the spirit of the invention.

What is claimed is:

1. In a modular wall system including (a) a wall panel having a rear surface (b) a forward standard having a front face, (c) a rearward pair of laterally-extending flanges, (d) a web extending between each flange and the front face and (e) at least one opening in each web for wall panel attachment, the improvement comprising:

a slideby bracket attached to the rear surface of the panel and including a tongue fixed with respect to the bracket and extending through the opening for slide-and-release panel mounting; and, the rear surface of the panel is substantially aligned with and parallel to the front face whereby the panel is mounted or demounted without tools.

2. The modular wall system of claim 1 wherein the opening has a lower end and the tongue includes a projection engaging the lower end and limiting lateral panel movement.

3. The modular wall system of claim 2 wherein the projection is downwardly extending and the panel is required only to be lifted for removal from the web.

4. The modular wall system of claim 1 wherein the webs and the bracket each have a front-to-rear dimension, such dimensions are substantially equal to one another and the rear surface abuts the front face.

5. The modular wall system of claim 1 wherein:

the bracket has a front surface spaced forwardly of the tongue by a first dimension;

the front face is spaced from the web opening by a second dimension substantially equal to the first dimension;

whereby the panel rear surface abuts the standard face.

6. The modular wall system of claim 4 wherein the system includes a panel supported by each web, each panel has a vertical edge, the standard includes vertical slots having a width and the space between panel edges is substantially equal to the slot width whereby the standard and slots are substantially concealed from view.

7. The modular wall system of claim 5 wherein the system includes a panel supported by each web, each panel has a vertical edge, the standard includes vertical slots having a width and the space between panel edges is substantially equal to the slot width whereby the slots are substantially concealed from view.

8. The modular wall system of claim 1 integrated into a modular wall frame defining a wall opening and the opening is covered by a panel having a rear surface abutting the face, the panel being mounted by a slideby bracket.

9. The modular wall system of claim 1 wherein the panel has a rear surface and a front surface, the bracket and the panel mounted by the bracket are attached to one another by at least one fastener inserted through the bracket toward the front surface.

10. In a modular wall system including (a) a wall panel, (b) a forward standard having a front face, (c) a rearward pair of laterally-extending flanges, (d) a web extending between each flange and the front face and (e) at least one opening in each web for wall panel attachment, the improvement comprising:

a slideby bracket mounting a panel to a web and including a tongue extending through the opening for slide-and-release panel mounting;

the bracket has a front surface spaced forward of the tongue by a first dimension;

the front face is spaced from the web opening by a second dimension substantially equal to the first dimension; and, the panel has a rear surface abutting the front face, whereby the panel is mounted or demounted without tools.

11. The modular wall system of claim 10 wherein:

the system includes two panels, each panel being supported by a separate web;

each panel has a vertical edge; the panel vertical edges are spaced;

the standard includes vertical slots having a width; and, the space between panel edges is substantially equal to the slot width, whereby the slots are substantially concealed from view.

* * * * *